US006119875A

United States Patent [19]

Smith

[11] Patent Number: 6,119,875

[45] Date of Patent: Sep. 19, 2000

[54] STAND FOR DISPLAYING HANGING MERCHANDISE

[75] Inventor: Michael J. Smith, Orangeburg, N.Y.

[73] Assignee: Arrow Art Finishers, L.L.C., Princeton, N.J.

[21] Appl. No.: 09/226,443

[22] Filed: Jan. 6, 1999

[51] Int. Cl.[7] ..... A47F 5/11; A47B 47/06; F16M 11/00

[52] U.S. Cl. ..... 211/59.1; 211/195; 248/174

[58] Field of Search ..... 211/59.1, 195, 211/57.1; 248/174

[56] References Cited

U.S. PATENT DOCUMENTS

| | | | |
|---|---|---|---|
| 1,647,154 | 11/1927 | Soybel | 248/174 X |
| 2,664,208 | 12/1953 | Goodman | 211/123 X |
| 2,918,178 | 12/1959 | Leone | 211/195 |
| 3,442,396 | 5/1969 | Cass | 211/182 X |
| 3,978,593 | 9/1976 | Pulitzer et al. | 211/59.1 X |
| 4,146,141 | 3/1979 | Winter et al. | 211/123 X |
| 5,000,717 | 3/1991 | Pfeiffer | 248/174 X |
| 5,632,390 | 5/1997 | Podergois | 211/195 |

*Primary Examiner*—Daniel P. Stodola
*Assistant Examiner*—Erica B. Harris
*Attorney, Agent, or Firm*—Kirschstein et al.

[57] ABSTRACT

Merchandise is suspended from support rods reliably held against tipping by support columns of folded sheet material. Each column has opposite corners formed with holes through which the rods extend. Flaps within the columns have additional holes for supporting the rods. Facing panels overlie and screen the columns. The panels and the columns rest on a base. The assembly comprises a display stand especially suitable for supporting bulky and/or heavy merchandise.

16 Claims, 2 Drawing Sheets

FIG. 1
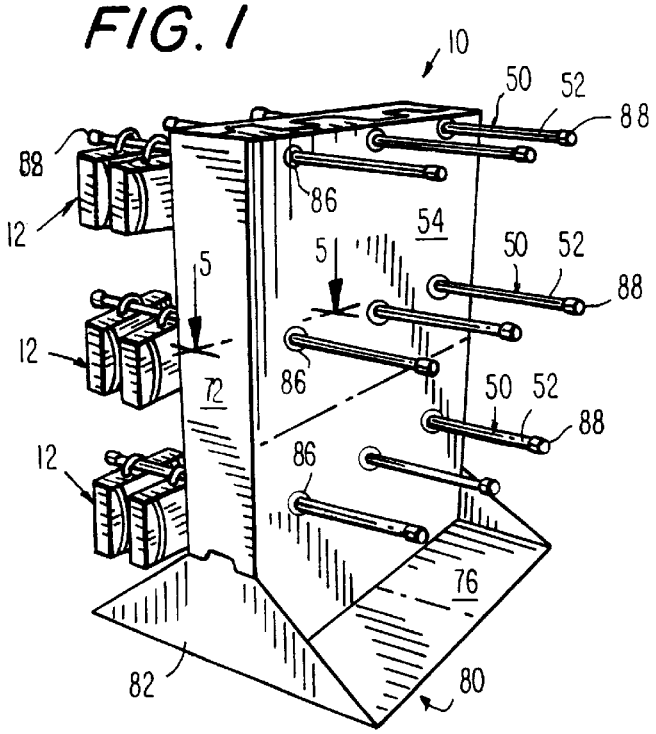
FIG. 2
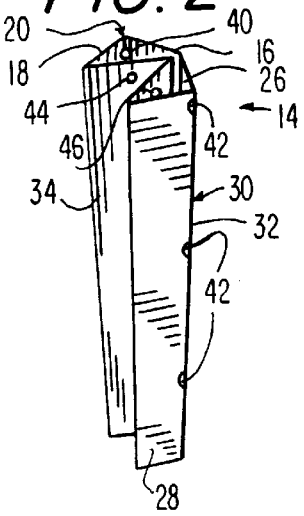
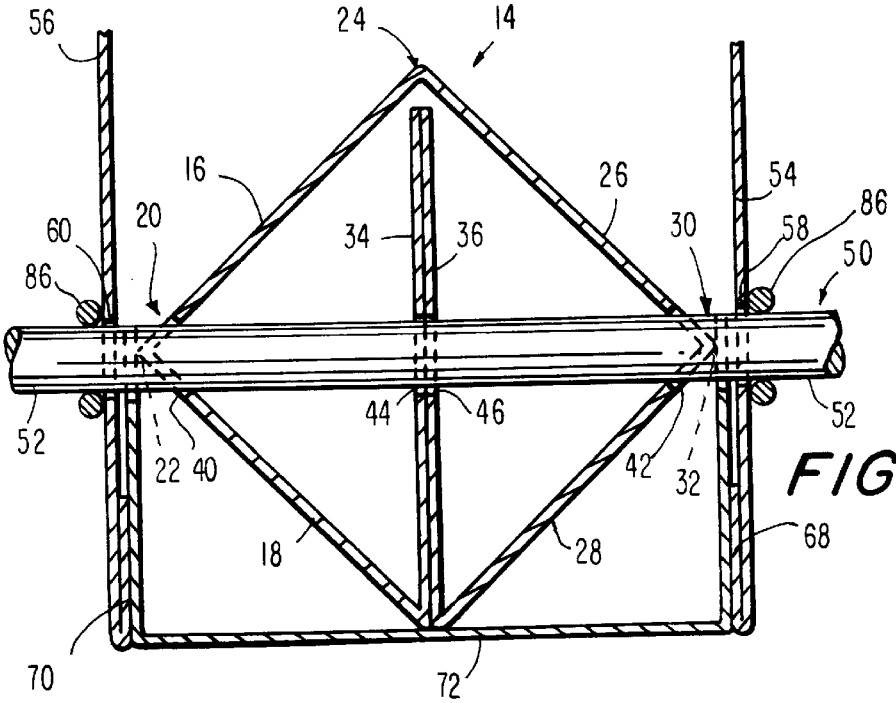
FIG. 5

STAND FOR DISPLAYING HANGING MERCHANDISE

BACKGROUND OF THE INVENTION

1. Field of the Invention

This invention generally relates to a stand for supporting objects and, more particularly, to a display stand for displaying hanging merchandise, especially multiple objects of substantial weight and/or bulkiness.

2. Description of the Related Art

Display stands made of metal are commonly used in stores to reliably support merchandise for display. The merchandise is placed on metal shelves or in inclined compartments or is suspended from hooks or pegs which are securely fixed to the metal stands.

As advantageous as these metal stands are, they are either permanent, built-in installations or not readily movable from place to place. As a result, display stands made of a foldable sheet material, especially corrugated board, have been increasingly used, primarily because the corrugated board stands are lightweight, easy to transport, simple to assemble and, in some cases, automatically erectable, and readily discardable. Such corrugated board stands can be printed with graphics and artwork descriptive of the product on display and can be transported and positioned virtually anywhere. Corrugated board stands have been designed with horizontal shelves, inclined compartments and elongated pegs to support the merchandise and are favored in stores, such as supermarkets, department stores or warehouse stores where there is a heavy turnover of merchandise and versatility in presenting merchandise is desired.

Some merchandise of a bulky nature, for example, backpacks and luggage, and/or of a heavy nature, for example, winter clothes, are hung in quantity from long rods supported horizontally on corrugated board stands. The rods are inserted through a hole in a single panel of the stand, or through a pair of aligned holes in two parallel panels of the stand. The rods need to be long enough to accommodate multiple items of the bulky merchandise. However, the long rods and the heavy merchandise due to their combined high moment tend to tip the rods and the stands, thereby rendering the stands unsuitable for their intended purpose.

SUMMARY OF THE INVENTION

Objects of the Invention

Accordingly, it is a general object of the present invention to reliably support one or more rods on a display stand made of a folded sheet material.

More particularly, it is an object of the present invention to maintain each rod in a generally horizontal orientation even when bulky and/or heavy and/or multiple merchandise is suspended therefrom.

Still another object of the present invention is to provide a merchandise display stand that is easily erectable, easy to transport, inexpensive to manufacture, durable in construction, and rugged in use.

Features of the Invention

In keeping with these objects and others which will become apparent hereinafter, one feature of this invention resides in a stand for supporting objects, especially hanging multiple objects of merchandise of a bulky and/or heavy nature, by mounting one elongated support rod, and preferably a plurality of such rods, by one upright support column, and preferably a plurality of such support columns.

Each column is constituted of a folded sheet material, preferably corrugated board, but cardboard could be used. Each column extends upwardly along a longitudinal direction away from the ground in a vertical orientation. The columns are spaced apart and successively arranged along a row. Each column has a first pair of walls meeting at a first corner along a first longitudinal fold line, and a second pair of walls meeting at a second corner along a second longitudinal fold line. The corners are spaced apart along a transverse direction generally perpendicular to the longitudinal direction.

Each column has at least one first bearing edge bounding a first hole extending through the first pair of walls and the first fold line at the first corner, and at least one second hole extending through the second pair of walls and the second fold line at the second corner. The first and second holes of each column are aligned along the transverse direction to form a passage through the respective column at a predetermined elevation above the ground. Multiple first and second holes are used to form multiple passages at different elevations relative to the ground.

Each rod is mounted in, and extends along, a respective passage. Each rod has a projecting end region extending beyond one side of a respective column, and preferably a pair of opposite end regions extending beyond opposite sides of the respective column. Objects are suspended from each end region.

In accordance with this invention, each rod is supported by the first and second bearing edges at the first and second corners of a respective column. This corner joint is particularly strong, because the rod is supported not only by bearing edges lying in two intersecting planes, but is supported by the respective fold line that extends from the joint to the ground. Even when heavy merchandise is supported from an end region, the rod does not tip, and the columns do not buckle, due to the inherent strength of each such reinforced corner joint.

For even greater reinforcement, a first longitudinal flap, and optionally, a second longitudinal flap are respectively hingedly connected to the first and second pairs of walls of a respective column. The first and second flaps have third and fourth bearing edges bounding third and fourth holes through which a respective rod extends in alignment with the first and second holes of the respective column. The first and second flaps are located between the first and second corners within the interior of a respective column, and preferably are in area contact with each other. The flaps lie in planes generally perpendicular to the rod extending therethrough. The additional support provided by the third and fourth bearing edges further increases the overall holding capability of each column.

The stand includes a pair of facing panels overlying and concealing the columns. The facing panels have mounting holes through which the end regions of the rods extend. A base may be provided for the columns and the facing panels to rest on. A header may also be provided at the top of the stand. Graphics and artwork descriptive of the merchandise may be printed on any of the facing panels, base or header to provide an aesthetically pleasing, functional display.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of an assembled merchandise display stand according to this invention;

FIG. 2 is a perspective view of a support column used in the stand of FIG. 1;

FIG. 5 is a sectional view on an enlarged scale taken on line 5—5 of FIG. 1.

DETAILED DESCRIPTION OF THE PREFERRED EMBODIMENT

Figure 3:
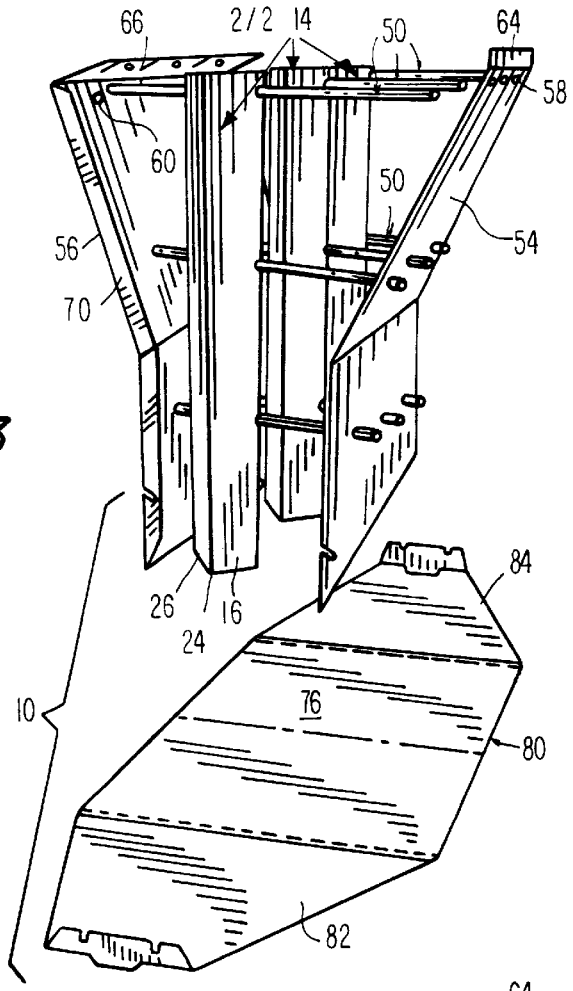
FIG. 3 is an exploded view of the stand of FIG. 1 at one stage of its assembly.
Figure 4:
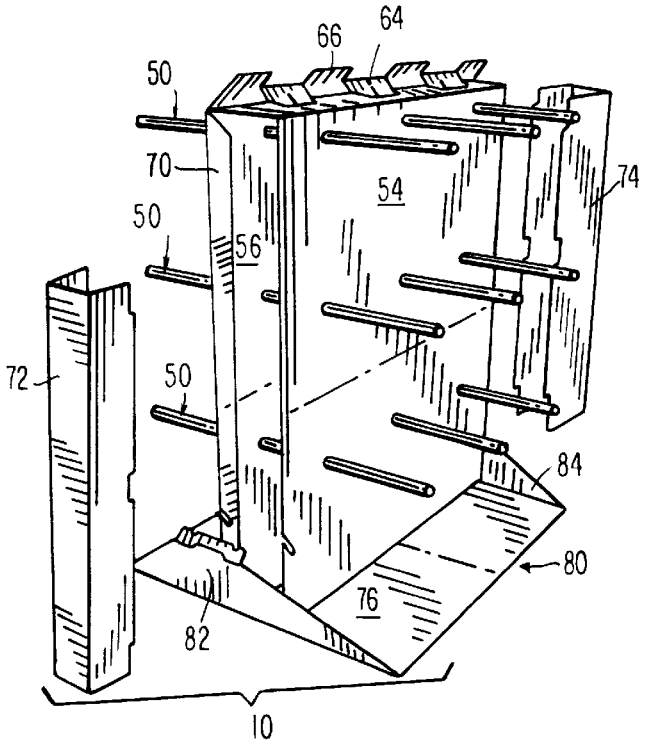
FIG. 4 is an exploded view of the stand of FIG. 1 at a subsequent stage of its assembly.

Referring now to the drawings, reference numeral 10 generally identifies a stand for supporting objects, especially a display stand for hanging merchandise. The display stand has particular utility in supermarkets, warehouse stores and department stores although other venues are contemplated. The stand is operative for displaying objects of a heavy and/or bulky nature. As shown in FIG. 1, reference numeral 12 generally identifies backpacks but, of course, any other objects, such as clothing, can be suspended from the stand for display.

The stand 10 includes at least one upright support column 14 shown in isolation in FIG. 2 and preferably three support columns, as shown in FIG. 3, are successively arranged in a row widthwise of the stand. More or less than three columns could be employed. Each column is constituted of a folded sheet material, such as corrugated board or cardboard, although other materials could be used. Each column extends upwardly along a longitudinal direction away from the ground in a vertical direction.

As best shown in FIG. 5, each column 14 has a first pair of walls 16, 18 hingedly connected and meeting at a first corner 20 along a first longitudinal fold line 22, and a second pair of walls 26, 28, hingedly connected and meeting at a second corner 30 along a second longitudinal fold line 32. The corners 20, 30 are spaced apart in a transverse direction along the depth of the stand. The walls 16, 26 are also hingedly connected and meet at a third corner 24. Wall 18 is hingedly connected to a first longitudinal flap 34. Wall 28 is hingedly connected to a second longitudinal flap 36. The walls 16, 18, 26, 28 form the column 14 with a hollow square-shaped cross-section. The flaps 34, 36 extend into the interior of the column 14 generally along a diagonal of the square column. The flaps 34, 36 are in area contact and are centrally located midway between the corners 20, 30.

Each column has a first bearing edge bounding a first hole 40 extending through the first pair of walls 16, 18 and the first fold line 22 at the first corner 20. Each column also has a second bearing edge bounding a second hole 42 extending through the second pair of walls 26, 28 and the second fold line 32 at the second corner 30. The flap 34 has a third bearing edge bounding a third hole 44 extending through the flap 34. The flap 36 has a fourth bearing edge bounding a fourth hole 46 extending through the flap 36. The holes 40, 42, 44, 46 are in alignment along the depth of the stand and together form a passage through the column 14 at a predetermined elevation above the ground.

As shown in FIG. 2, there are three sets of the aligned holes 40, 42, 44, 46 or passages at different elevations. More or less than three such passages can be employed. The passages are shown as spaced equally apart along the vertical direction, although it will be understood that unequal spacings may be used.

An elongated support rod 50 is mounted in, and extends along, each passage. The rod 50 is supported by the first, second, third and fourth bearing edges bounding the holes 40, 42, 44, 46. The first and second bearing edges are particularly strong, because each has two edge portions lying in planes intersecting at the corners 20, 30 and each has a central fold line 22, 32 or crease that extends from the respective bearing edge toward the ground.

Each rod 50 has at least one end region and, as shown, a pair of opposite end regions 52 projecting beyond opposite sides of the stand. The objects 12 are suspended from these end regions either directly or on hangers or brackets. The rod itself is made of a rigid material such as a cardboard tube, or a wooden or a metal bar. As depicted in the drawings, nine such rods are employed, one for each of the three passages, and three for each of the three columns. It will be understood that more or less than nine rods could be employed.

In the preferred embodiment, the columns 14 are screened from view by a pair of facing panels 54, 56 that extend along the full vertical height and along the full horizontal width of the row of columns. Each facing panel 54, 56 has mounting holes 58, 60 in alignment with the sets of holes 40, 42, 44, 46 at the different elevations described above. The opposite end regions of the rods are inserted through the mounting holes which serve not only to support the facing panels in a generally upright orientation, but also to additionally support the rods. The facing panels are pushed toward the columns until the panels engage the columns.

The facing panels 54, 56 are provided with top marginal portions 64, 66 that are foldable relative to the panels 54, 56 to engage each other in a generally horizontal position, thereby closing the top of the stand in the fully assembled condition. The facing panels 54, 56 are also provided with side marginal portions 68, 70 (see FIG. 5) that are foldable inwardly into engagement with the panels to stiffen the panels. A pair of end covers 72, 74 are fitted into the open ends of the stand between the side marginal portions 68, 70, thereby closing the ends of the stand in the fully assembled condition. Instead of end covers, the side marginal portions can be made larger and folded to lie in planes perpendicular to the panels to close the open ends of the stand. However, this latter design is not preferred since the end cover design provides for a more finished appearance.

The stand, as assembled so far, is placed on a center section 76 of a base panel 80 having opposite tapered ends 82, 84 that are folded upwardly and are locked onto end edges of the facing panels 54, 56. The center section 76 extends beyond the facing panels to provide a wide, stable base.

As seen in FIG. 1, an O-ring 86 of elastomeric material is mounted on each rod 50 and slid over to engage the respective facing panel at each mounting hole. This secures the facing panels in position. Also, end caps 88 are closely fitted at the free ends of each rod in order to prevent the objects from sliding off the rods and also to provide a more finished look.

The stand holds the rods stable in their generally horizontal position, primarily due to the support provided by the columns, especially by the holes 40, 42, which extend through the corners 20, 30. When objects are arranged along the projecting end regions of the rods, the moment of each object, i.e., the product of the weight of each object and its distance along the rod to its support on the column, increases as the weight and the distance increase. Thus, whereas bulkier, heavier and multiple objects have a greater moment and cause the rods of the prior art stands to tilt, the reinforced stand of this invention effectively resists such tilting.

Although not illustrated, a header panel can be mounted on the top of the stand. Indicia descriptive of the objects on display can be printed on the header panel, or on any of the facing panels, base panel or end covers.

It will be understood that each of the elements described above, or two or more together, also may find a useful application in other types of constructions differing from the types described above.

While the invention has been illustrated and described as embodied in a stand for displaying hanging merchandise, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

What is claimed:

1. A stand for supporting objects, comprising:

a) an upright support column of folded sheet material extending upwardly along a longitudinal direction away from the ground, the column having a first pair of walls meeting at a first corner along a first longitudinal fold line, and a second pair of walls meeting at a second corner along a second longitudinal fold line, the walls of the column bounding an interior, i) the corners being spaced apart along a transverse direction generally perpendicular to the longitudinal direction, the column having a first bearing edge bounding a first hole extending through the first pair of walls and the first fold line at the first corner, and a second bearing edge bounding a second hole extending through the second pair of walls and the second fold line at the second corner, the column having a first longitudinal flap hingedly connected to one of the first pair of walls and extending into the interior and a second longitudinal flap hingedly connected to one of the second pair of walls and extending into the interior, the first flap having a third bearing edge bounding a third hole extending through the first flap, the second flap having a fourth bearing edge bounding a fourth hole extending through the second flap, the first and second flaps being in area contact with each other, ii) the first, second, third, and fourth holes being aligned along the transverse direction to form a passage through the column at a predetermined elevation above the ground; and b) an elongated support rod mounted in, and extending along, the passage through the first, second, third, and fourth holes, the rod being supported by the first, second, third, and fourth bearing edges and having a projecting end region that extends beyond the column for supporting the objects on the end region above the ground.

2. The stand according to claim 1; and further comprising additional first and second holes extending respectively through the first and second pairs of walls at the first and second corners to form an additional passage through the column at an additional elevation that is different from the predetermined elevation; and further comprising an additional support rod mounted in, and extending along, the additional passage through the additional first and second holes.

3. The stand according to claim 1, wherein the column has opposite sides, wherein the projecting end region extends past one of the sides, and wherein the rod has an opposite projecting end region extending past the opposite side of the column, both end regions being rigid for supporting the objects at both sides of the column.

4. The stand according to claim 1, wherein the first and second flaps are located between the first and second corners as considered along the transverse direction.

5. The stand according to claim 4, wherein the first and second flaps lie in planes generally perpendicular to the elongated rod.

6. The stand according to claim 1; and further comprising a supplementary upright support column identical to said first-mentioned column and having a supplementary passage identical to said first-mentioned passage at the predetermined elevation; and further-comprising a supplementary rod extending through the supplementary passage.

7. The stand according to claim 6; and further comprising a pair of facing panels overlying both columns and having mounting holes through which the end regions of both rods extend for supporting the facing panels in an upright stance.

8. The stand according to claim 7; further comprising a base on which the columns and the facing panels rest.

9. A stand for supporting objects, comprising:

a) a plurality of upright support columns of folded material, each column extending upwardly along a longitudinal direction away from the ground, the columns being spaced apart, and arranged in a row, along a row direction generally perpendicular to the longitudinal direction, each column having a first pair of walls meeting at a first corner along a first longitudinal fold line, and a second pair of walls meeting at a second corner along a second longitudinal fold line, the walls of each column bounding respective interiors, i) the corners of each column being spaced apart along a transverse direction generally perpendicular to the longitudinal and row directions, each column having a first bearing edge bounding a first hole extending through the first pair of walls and the first fold line at the first corner of a respective column, and a second bearing edge bounding a second hole extending through the second pair of walls and the second fold line at the second corner of the respective column, each column having a first longitudinal flap hingedly connected to one of the first pair of walls and extending into the interior of a respective column, the first flap having a third bearing edge bounding a third hole extending through the first flap, each column having a second longitudinal flap hingedly connected to one of the second pair of walls and extending into the interior of the respective column, the second flap having a fourth bearing edge bounding a fourth hole extending through the second flap, the first and second flaps being in area contact with each other, ii) the first, second, third, and fourth holes of each column being aligned along the transverse direction to form a plurality of passages through the columns at a predetermined elevation above the ground; and b) a plurality of elongated support rods, each mounted in, and extending along, a respective passage through the first, second, third, and fourth holes of each column, each rod being supported by the first, second, third and fourth bearing edges of the respective column and having opposite projecting end regions that extend beyond opposite sides of the respective column for supporting objects on both end regions above the ground.

10. The stand according to claim 9; and further comprising additional first and second holes extending respectively through the first and second pairs of walls at the first and second corners of respective columns to form additional passages through the respective columns at an additional elevation that is different from the predetermined elevation; and further comprising additional support rods mounted in, and extending along, the additional passages through the additional first and second holes of the respective columns.

11. The stand according to claim 9, wherein each column is constituted of a single sheet of corrugated board material.

12. The stand according to claim 9, wherein each rod is constituted of a rigid material.

13. The stand according to claim 9, wherein the first and second flaps of each column are located between the first and second corners of each column as considered along the transverse direction.

14. The stand according to claim 13, wherein the first and second flaps of each column lie in planes generally perpendicular to the rods.

15. The stand according to claim 9; and further comprising a pair of facing panels overlying the plurality of columns and having mounting holes through which the rods extend for supporting the facing panels in an upright stance.

16. The stand according to claim 15; and further comprising a base on which the columns and the facing panels rest.

* * * * *